US005388372A

United States Patent [19]

Zanoni

[11] Patent Number: 5,388,372

[45] Date of Patent: Feb. 14, 1995

[54] METAL SECTION WITH AN OCTAGONAL CROSS-SECTION FOR WINDOW OR DOOR FRAMES

[75] Inventor: Edoardo Zanoni, Milan, Italy

[73] Assignee: Hydro Alluminio Ornago S.p.A., Italy

[21] Appl. No.: 30,310

[22] PCT Filed: Jul. 20, 1991

[86] PCT No.: PCT/EP91/01375

§ 371 Date: Mar. 31, 1993

§ 102(e) Date: Mar. 31, 1993

[87] PCT Pub. No.: WO92/02706

PCT Pub. Date: Feb. 20, 1992

[30] Foreign Application Priority Data

Jul. 31, 1990 [IT] Italy ..... 21586/90[U]

[51] Int. Cl.[6] ..... E06B 7/14

[52] U.S. Cl. ..... 49/408; 49/381; 49/504

[58] Field of Search ..... 49/408, 471, 504, 381

[56] References Cited

U.S. PATENT DOCUMENTS

| | | | |
|---|---|---|---|
| 2,768,716 | 10/1956 | Gillespie | 49/408 |
| 2,918,706 | 12/1959 | Rust et al. | 49/408 |
| 3,555,736 | 1/1971 | Koch et al. | 49/504 |
| 3,570,182 | 3/1971 | Bakke | 49/408 |
| 4,259,813 | 4/1981 | Winner et al. | 49/504 |
| 4,941,288 | 7/1990 | Morton | 49/504 |

FOREIGN PATENT DOCUMENTS

| | | | |
|---|---|---|---|
| 2626931 | 8/1989 | France . | |
| 2930539 | 3/1981 | Germany . | |
| 297711 | 11/1965 | Netherlands . | |
| 483549 | 12/1969 | Switzerland . | |
| 1295535 | 11/1972 | United Kingdom | 49/408 |
| 2159562 | 12/1985 | United Kingdom | 49/408 |

*Primary Examiner*—Michael J. Milano

*Attorney, Agent, or Firm*—Nixon & Vanderhye

[57] ABSTRACT

The section has a tubular shape with a substantially polygonal cross-section, provided with two larger faces (1, 2) opposite to one another and two smaller faces (3, 4) forming a connection with said larger faces, which extend in abutment elements (5, 6) suitable for defining with said larger faces the inner front and the outer front, respectively, of the window or door frame. The two larger faces (1, 2) comprise respective central portions (11, 12) parallel to one another provided with flaps (13, 14) defining C-shaped cavities (15, 16) for housing and connecting various members of the window or door frame. Each larger face also comprise lateral portions (17, 19; 18, 20) converging towards the corresponding lateral portions of the other larger face until they connect with the smaller faces. The section includes a hole (21) for drainage purposes.

5 Claims, 2 Drawing Sheets

METAL SECTION WITH AN OCTAGONAL CROSS-SECTION FOR WINDOW OR DOOR FRAMES

BACKGROUND

I. Field of the Invention

The present invention relates to a metal section with an octagonal cross-section for window or door frames.

II. Related Art and Other Considerations

Aluminum alloy metal sections have been used for the construction of window or door frames of various kinds, in particular for external windows.

It is also known that the same section may be used for the fixed parts and for the movable parts of the window or door frame.

As shown in the utility model application No. 21900 B/89 filed on Oct. 10, 1989 in the name of the same applicant, such a section has a tubular shape with a substantially rectangular cross-section such a section has two essentially flat larger sides provided with respective pairs of outer flaps suitable for defining respective C-shaped cavities for connecting parts of a hinge to other members to be associated with the section. Such a section also has two smaller sides perpendicular to the previous ones, which extend in abutment elements suitable for defining, with the smaller sides themselves, the inner front and the outer front, respectively, of the window or door frame.

Again according to the known art, with two equal sections it is possible to accomplish a connection of the traditional type, that is with seals in turn of the traditional type, acting by compression and housed in appropriate seats of the abutment elements. It is also possible to connect one of these sections to a section of a slightly different type for accomplishing a connection of the open-joint type, that is with the seal floating inside the window or door frame.

In the traditional solution the stagger between the two abutment elements is used to house the seals, while in the open-joint solution there is a substantial coplanarity of the outer sides and a variable seal is arranged in an internal space between the two sections.

In both cases there can be an leakage of water which stagnates inside the window or door frame without drainage.

The object of the present invention is to overcome such a drawback with a metal section shaped so that any water that has infiltrated between the fixed part and the movable part of the frame can be eliminated immediately.

SUMMARY

According to the invention such object is attained with a metal section for window or door frames, having a tubular shape with a substantially polygonal cross-section. The metal section is provided with two larger faces opposite to one another and two smaller faces forming a connection with said larger faces. The smaller faces extend to form abutment elements suitable for defining with said smaller faces the inner front and the outer front, respectively, of the window or door frame. The said larger faces comprise respective central portions parallel to one another provided with flaps defining C-shaped cavities for housing and connecting various members of the window or door frame. Each of said larger faces also comprises lateral portions converging towards the corresponding lateral portions of the other larger face until they connect with said smaller faces.

At the intersection between said smaller face defining the outer front of the window or door frame and said first larger face there is at least one hole suitable for allowing any water that may have infiltrated to flow away.

In such way the presence of the inclined lateral portions allows the formation of a kind of small lateral reservoir in which any water that may have infiltrated is invited to collect and then to flow away through the above hole. Water will thus be prevented from stagnating inside the window or door frame.

BRIEF DESCRIPTION OF THE DRAWINGS

The features of the present invention shall be made more evident by the following detailed description of an embodiment illustrated as a non-limiting example in the enclosed drawings, wherein:

FIGS. 2 and 5 illustrate respective methods of utilization of the metal section according to the invention, with the traditional solution with a seal and with the open-joint type, respectively.

DETAILED DESCRIPTION OF THE DRAWINGS

Figure 1:
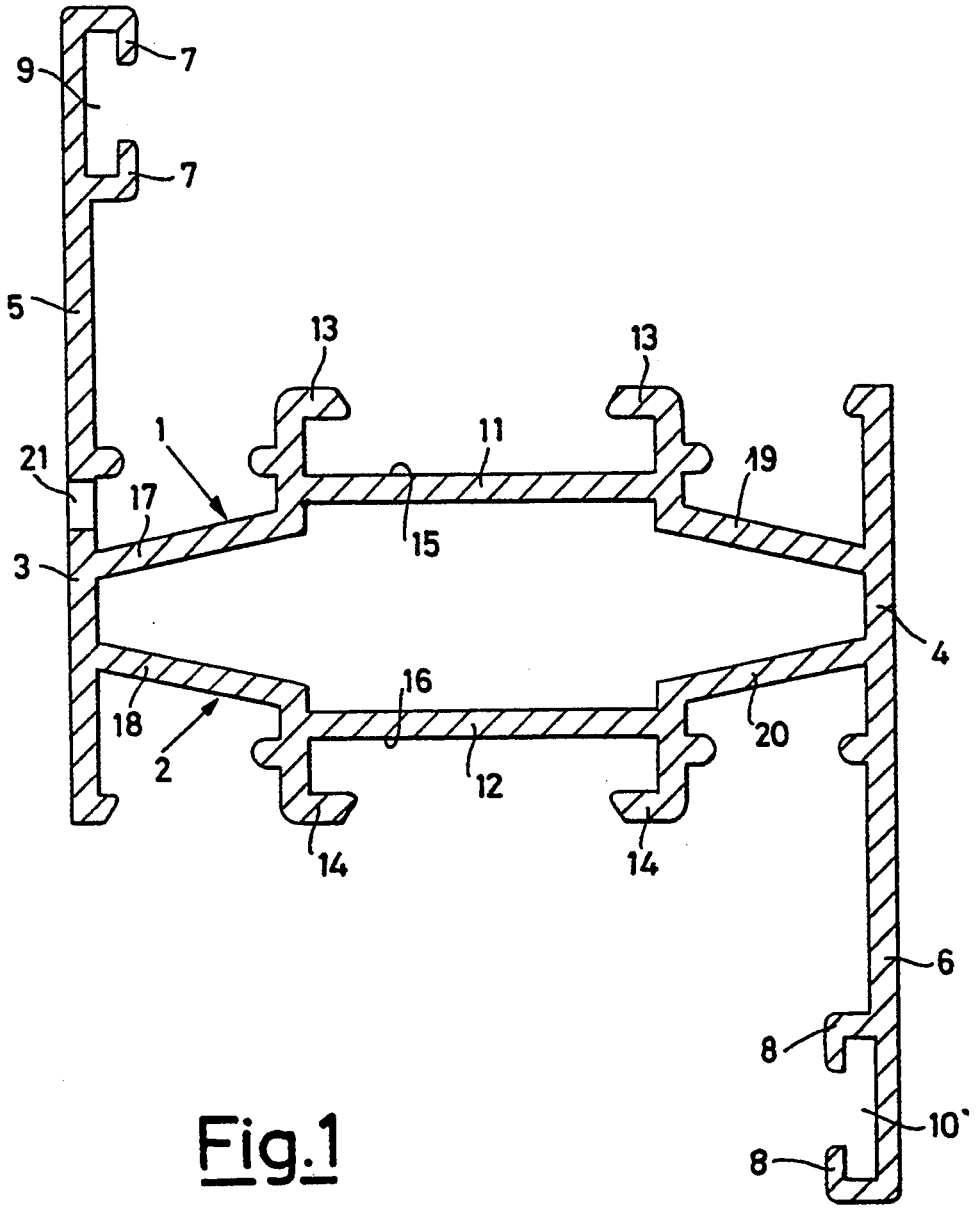
FIG. 1 illustrates a metal section according to the invention.

With reference to FIG. 1, the metal section according to the invention is configured with a tubular shape having a substantially polygonal cross-section with a first and a second larger face 1, 2 opposite to one another and two smaller faces 3, 4 forming a connection between the two larger faces 1, 2 (also known as first and second bridge members 1, 2). The smaller faces 3, 4 to form extend abutment elements 5, 6 suitable for defining together with the same smaller faces 3, 4 the inner front and the outer front of the window or door frame. The abutment elements 5, 6 have respective pairs of opposite flaps 7, 8 suitable for defining smaller cavities 9, 10. The first and second larger faces 1, 2 comprise central portions 11, 12 (also known as central sections 11, 12) parallel to one another provided with flaps 13, 14 defining C-shaped cavities 15, 16 for the purposes which shall be explained later. The first larger face 1 also comprises lateral portions 17, 19 (also known as end portions or edge sections) converging towards corresponding lateral portions 18, 20 (also known as end portions or edge sections) of the second larger face 2. On the abutment element 5, at the intersection with the larger face 1, there are holes 21 for the purposes which shall be explained later. A polygonal intra-section cavity, illustrated in FIG. 1 as being an octagon, is formed between larger face (i.e., bridge member) 1 and larger face (i.e. bridge member 2).

Figure 2:
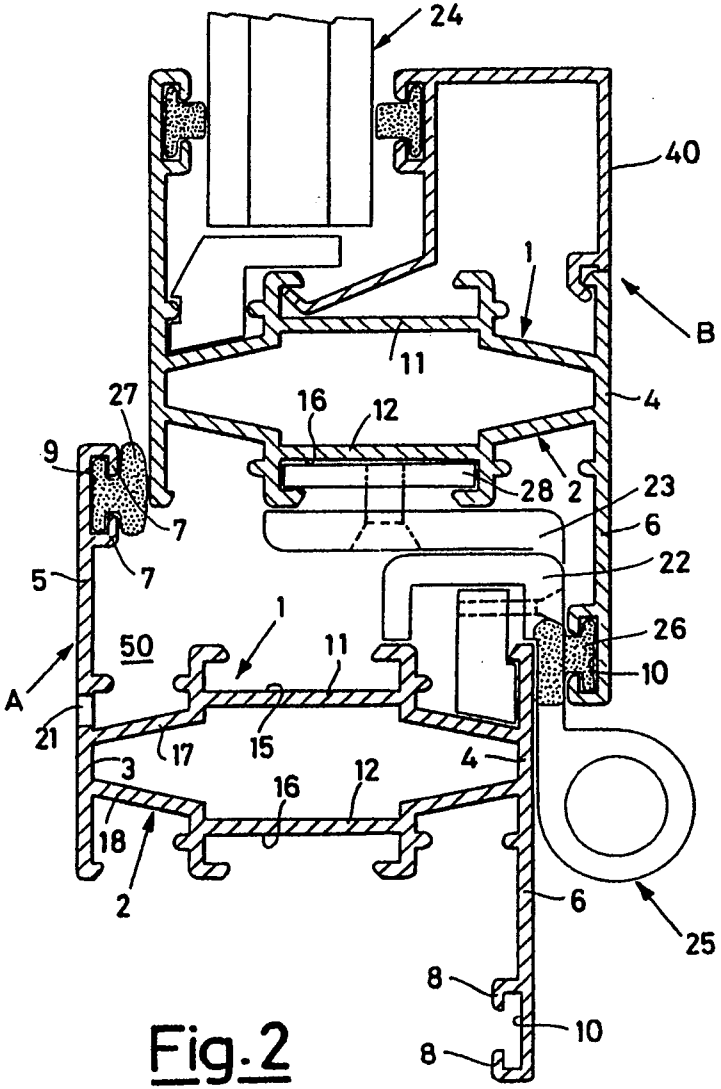

As illustrated in FIG. 2, according to the traditional connection, two sections A and B identical with that of FIG. 1 are used for the fixed part and for the movable part of the window or door frame. For the fixed part a section A is fastened in a way known in itself to the jamb, not shown, and to the fixed part 22 of a hinge 25. According to such a solution an identical section B holding a pane of glass 24 with the help of an element 40 holding the pane of glass receives in the C-shaped cavity 16 of the larger face 12 a connecting element 28 for the movable part 41 of the hinge 25. Between the abutment elements 6 of the two sections A and B there is defined a space or inter-section suitable for the passage of the fixed and movable parts 22 and 23 of the hinge 25 and for the housing of a seal 26 inserted in the cavity 10 of the section B, while between the abutment elements 5 of the same sections there is defined the space necessary for the housing a seal 27 inserted in the cavity 9 of the section A.

Due to the effect of the convergence of the lateral portions 17 and 18 of the section A, any water that may have infiltrated through the seal 27 is collected in a small reservoir 50 formed by the inclination of the above portion 17 so that it may later be made to flow through the hole 21 of the same section A.

Figure 3:
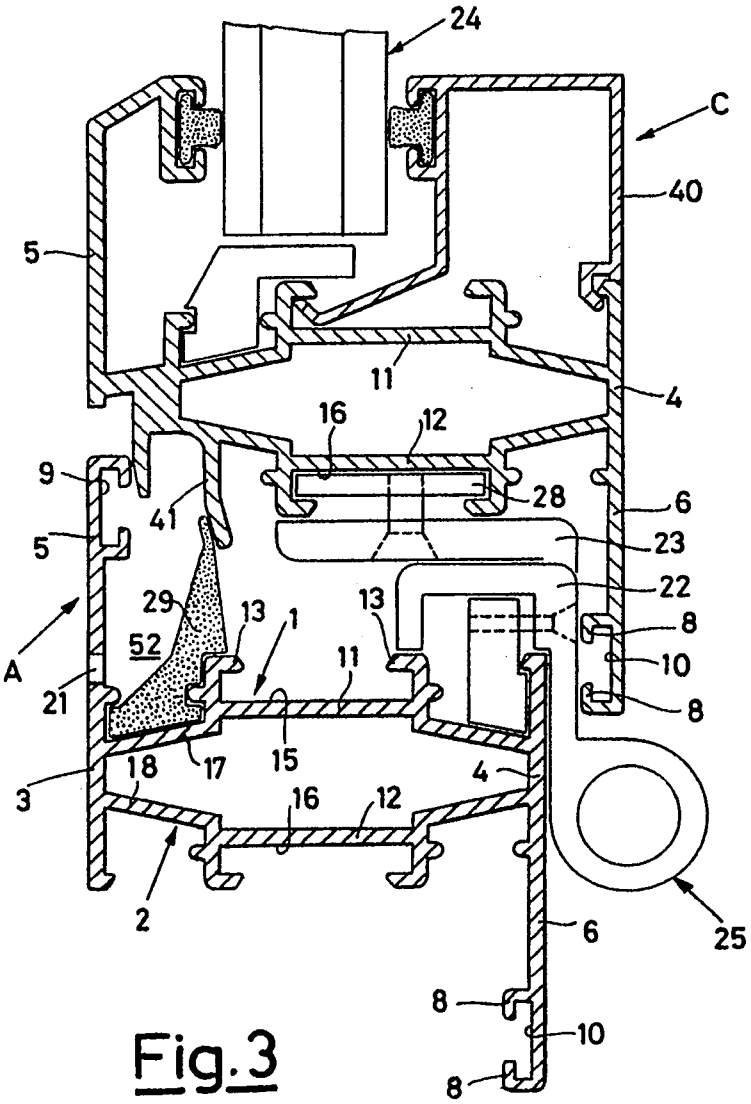

As illustrated in FIG. 3, an open-joint connection involves the use of a section A in combination with a slightly different section. There occurs in this case a coplanarity of the abutment elements 5 of the sections A and C at the outer front of the window or door frame and a variable seal 29 is arranged in an internal space between the two sections A, C, defined by a tang 41 of the section C and a nearby flap 13 of the section A.

Any water that may have penetrated through the passage between the extension 5 of the smaller side 3 of the section A and that of the section C is collected in a small reservoir 52 created by the seal 29 to be then discharged through the hole 21 in a manner altogether similar to that illustrated previously.

I claim:

1. A metal section for window or door frames, having a tubular shape with a substantially polygonal cross-section defined by two peripheral larger faces opposite to one another and two peripheral smaller faces opposite to one another, which two smaller faces connect said larger faces and extend to form respective abutment elements suitable for defining inner and outer fronts, respectively, of the window or door frame, said larger faces comprising respective central portions parallel to one another and provided with flaps defining substantially C-shaped cavities for housing and connecting various members of the window or door frame, said larger faces also each comprising two end portions connected respectively with said smaller faces, wherein said end portions of each larger face are obliquely converging towards the corresponding end portions of the other larger face for collecting any infiltrated water, and wherein at least one hole is provided in the abutment element defining the outer front of the window or door frame near its intersection with the closest larger face for allowing the collected water to flow away.

2. A metal section of claim 1, wherein said polygon is a octagon.

3. A combination of two metal sections which cooperatively mate to form a window or door frame, each metal section comprising:

two abutment elements disposed in parallel relationship;

two bridge members for connecting the two abutment elements, the two bridge members each having:

a central section, a first edge section on a first side of the central section, the first edge section being connected to a first of the two abutment elements, a second edge section on a second side of the central section, the second edge section being connected to a second of the two abutment elements, the central sections of the two bridge members being parallel to one another and essentially perpendicular to the two abutment elements, the first edge sections of the two bridge members converging toward one another and the second edge sections of the two bridge members converging toward one another;

at least one of the abutment elements having a drain hole formed therein proximate a connection of one of the edge sections thereto, at least one of the abutment elements being configured to receive a seal between abutment elements of two cooperating metal sections which are mated together, wherein an inter-section cavity is formed between the two metal sections when the two cooperating metal sections are mated together, the intra-section cavity including a moisture reservoir at least partially formed by one of the edge sections; and wherein the drain hole serves to drain moisture from the reservoir.

4. The combination of claim 3, wherein a polygonal intra-section cavity is formed between the two bridge members.

5. The combination of claim 4, wherein the intra-section cavity has the shape of an octagon.

* * * * *